US006206009B1

(12) United States Patent
Paxson

(10) Patent No.: US 6,206,009 B1
(45) Date of Patent: Mar. 27, 2001

(54) DECORATIVE ARTIFICIAL FINGERNAILS AND APPARATUS FOR USE BY CHILDREN

(75) Inventor: Patricia Paxson, San Pedro, CA (US)

(73) Assignee: Mattel, Inc. (SV)

( * ) Notice: Subject to any disclaimer, the term of this patent is extended or adjusted under 35 U.S.C. 154(b) by 0 days.

(21) Appl. No.: 09/501,871

(22) Filed: Feb. 10, 2000

(51) Int. Cl.[7] ..... A45D 29/00; A45D 29/18; A63H 33/30

(52) U.S. Cl. ..... 132/73; 132/73.5; 446/475

(58) Field of Search ..... 132/73, 73.5, 75.3, 132/75.4, 75.5; 446/475, 296, 26

(56) References Cited

U.S. PATENT DOCUMENTS

| | | | |
|---|---|---|---|
| D. 303,161 | 8/1989 | Tomkins | 28/56 D |
| D. 346,464 | 4/1994 | Romano | 132/73 |
| 2,013,290 | 9/1935 | Rohrbach . | |
| 4,107,947 | 8/1978 | Saito | 63/2 |
| 4,974,610 | 12/1990 | Orsini | 132/73 |
| 5,239,840 | 8/1993 | Sutterlin | 63/2 |
| 5,638,835 | 6/1997 | Franz et al. | 132/200 |
| 5,699,813 | 12/1997 | Carroll | 132/73 |
| 5,778,900 | 7/1998 | Bate | 132/73 |
| 5,806,537 | 7/1998 | Wittwer | 132/200 |
| 5,860,429 | 1/1999 | Chang | 132/73 |
| 5,890,495 | 4/1999 | Cain | 132/73 |
| 5,928,457 | 7/1999 | Engler | 156/297 |
| 5,960,798 * | 10/1999 | Jenkins et al. | 132/73 |
| 6,024,099 * | 2/2000 | Jenkins et al. | 132/73 |
| 6,065,478 * | 5/2000 | Hartelius et al. | 132/73 |
| 6,067,996 * | 5/2000 | Weber et al. | 132/73 |
| 6,085,757 * | 7/2000 | Jenkins et al. | 132/200 |

* cited by examiner

*Primary Examiner*—John J. Wilson
*Assistant Examiner*—Robyn Kieu Doam
(74) *Attorney, Agent, or Firm*—Roy A. Ekstrand

(57) ABSTRACT

A fingernail apparatus includes a base supporting a nail press station and a sprue cutting station in a spaced apart relationship. A sprue support is movably supported between the press station and the sprue cutting station. The sprue support receives one or more arcuate sprues having pluralities of radially extending artificial fingernails supported thereby. The sprue support also receives a nail cap sprue having an arcuate shape and supporting a corresponding plurality of radially extending nail caps. Each artificial nail is constructed to receive a corresponding nail cap in a snap-fit attachment. A space is created between the nail and its nail cap which receives a plurality of ornament objects. The sprue support is movable to the pressing station to snap-fit each nail cap within its underlying artificial nail. Thereafter, the sprue support is further movable to position each nail cap and artificial nail pair within the sprue cutting station to facilitate separation thereof from the sprue in a cutting operation. The separated nail and nail cap combinations captivating ornament articles therein are collected in a drawer formed within the base.

10 Claims, 6 Drawing Sheets

DECORATIVE ARTIFICIAL FINGERNAILS AND APPARATUS FOR USE BY CHILDREN

FIELD OF THE INVENTION

Toy playsets which facilitate and aide children in play patterns which attempt to mimic or reflect adult activities are extremely popular in the toy arts. Children appear to instinctively desire to imitate activities undertaken by adults in a phenomenon which appears to extend to even the most ordinary and mundane daily adult activities. In response to this characteristic and desire by young children, practitioners in the toy arts have through the years provided a virtually endless variety of toys and toy playsets which attempt to provide children with the ability to imitate adults. Thus, toy products have been provided which simulate a virtually endless variety of adult activities including various occupational and working activities, devices such as telephones or typewriters or the like, simulated vehicle driving apparatus, as well as various playsets which involve imitation of child care.

One type of adult activity which seems to be extremely intriguing to young girls is found in cosmetic and make-up application and use. Toy practitioner's often provide children's cosmetics and child safe make-up in various forms and playsets. In some instances, miniature or reduced sized vanity playsets which generally imitate a woman's vanity or dressing table have been provided.

The relatively resent rise in popularity of artificial fingernails among women of virtually every adult age has created a situation in which it would be expected that young girls such as pre-adolescent and adolescent may be expected to desire to mimic this adult activity. As is the case with most toys appealing to children's desire to mimic adult activity, it would be expected that the various factors characteristics and improvements provided by practitioner's in the artificial nail art for adult use would also be important to children.

The artificial nail art has exhibited a substantial variety of nail devices and apparatus for applying artificial nails. A virtually endless variety of styles, colors and other appearance factors have been provided. For example, U.S. Pat. No. 5,928,457 issued to Engler sets forth a PROCESS FOR MAKING DECORATED NAILS in which crumbled pieces of metallic foil or pieces of tissue paper are mixed with a substantially clear polish and applied to a nail to present a texture or effect similar to stained glass.

U.S. Pat. No. 5,890,495 issued to Cain sets forth a STENCILED DISPOSABLE GLOVE AND METHOD FOR POLISHING AND FILING NAILS having a plurality of cut-out stencil apertures in various shapes formed in the end portions of each glove digit. An inner adhesive dot is provided proximate each cut-out shape for stabilizing the glove tips over the nails. Nail polish is then applied to the tips of the stenciled glove to form designs on the nails underneath.

U.S. Pat. No. 5,860,429 issued to Chang sets forth a DOUBLE TOP ORNAMENTAL FINGERNAIL ACCESSORY having an elongated overlay having a top surface and a bottom surface and first and second ends. A base portion is fixed to an substantially coextensive with at least a portion of the overlay. In the preferred embodiments, the overlay is transparent or translucent while the base is translucent or opaque.

U.S. Pat. No. 5,806,537 issued to Wittwer sets forth an ARTIFICIAL SUPPORT NAIL AND METHOD FOR APPLYING ARTIFICIAL SUPPORT NAIL which is applied to the entire undersurface of a natural fingernail to encourage growth of the natural nail without breaking.

U.S. Pat. No. 5,699,813 issued to Carrol sets forth an ARTIFICIAL FINGERNAIL WITH INLAY having a colored fingernail with a lighter colored cuticle and tip end portions and a darker color central portion.

U.S. Pat. No. 5,638,835 issued to Franz et al. sets forth a POROUS ARTIFICIAL NAIL for attachment to a natural fingernail. The artificial nail includes a flexible polymeric body contacting the natural fingernail upper surface. The artificial fingernail further includes a plurality of pores dispersed throughout the body which are adapted to quickly wick liquid adhesive throughout the body.

U.S. Pat. No. 5,239,840 issued to Sutterlin sets forth a DECORATIVE INSERT FOR ARTIFICIAL FINGERNAILS in which an artificial fingernail defines an aperture through which a raised decorative insert is inserted and secured to the nail undersurface.

U.S. Pat. No. 4,974,610 issued to Orsini sets forth a PHOTOGRAPHIC IMPRINTING OF ARTIFICIAL FINGERNAILS in which an image is photographically imprinted on a semi-rigid layer of photographic film. The photographic film is laminated over the nail which in turn is covered by a transparent plastic film.

U.S. Pat. No. Des.303,161 issued to Tomkins sets forth an ARTIFICIAL FINGERNAIL WITH CLOCK/CALENDAR DISPLAY having a clock and nail display supported on the undersurface of the nail which is viewable through an aperture formed in the nail.

U.S. Pat. No. Des.346,464 issued to Romano sets forth an ARTIFICIAL FINGERNAIL having an intricate visual image thereon.

U.S. Pat. No. 2,013,290 issued to Rohrbach sets forth a DEVICE FOR FINGERNAILS having a crescent shaped member securable to the end portion of a natural nail.

U.S. Pat. No. 4,107,947 issued to Saito sets forth a FINGERTIP ORNAMENT which may be readily attached to and removed from a fingertip and which includes a plurality of C-shaped bridge members each open at the bottom commonly joined at their bottom edges to form an attachment which may be fitted upon a fingertip and fingernail.

While the foregoing described prior art devices have improved the art surrounding artificial nails to some extent, there remains a continuing need in the art for children's toy playsets which are constructed to appeal to young children and which are interesting, amusing and unusual in their use.

SUMMARY OF THE INVENTION

Accordingly, it is a general object of the present invention to provide an improved artificial fingernail and apparatus for use by young children. It is a more particular object of the present invention to provide an improved artificial fingernail and apparatus for use by young children which enhances the play value of forming and fabricating the artificial nails. It is a still more particular object of the present invention to provide an improved apparatus and artificial fingernail for use by children which is configured to aide relatively young children in manipulating the artificial fingernails.

In accordance with the present invention there is provided an artificial fingernail decorating and fabricating playset comprising: a plurality of arcuate nail sprues each having a plurality of curve nails joined thereto by a supporting branch; a plurality of arcuate nail cap sprues each having a plurality of nail caps joined thereto by a supporting branch; a base; a sprue support constructed to receive and support selected ones of the nail sprues and the nail cap sprues, the sprue support being supported upon the base and being movable between a first position and a second position and being rotatable at each of the first and second positions; a nail pressing station supported by the base and positioned to receive a selected nail and selected nail cap, the nail pressing station having means for pressing the selected nail cap into the selected nail; and a sprue cutting station supported by the base and positioned to receive a selected nail and selected nail cap, the sprue cutting station having means for cutting the supporting branches of the selected nail and nail cap.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
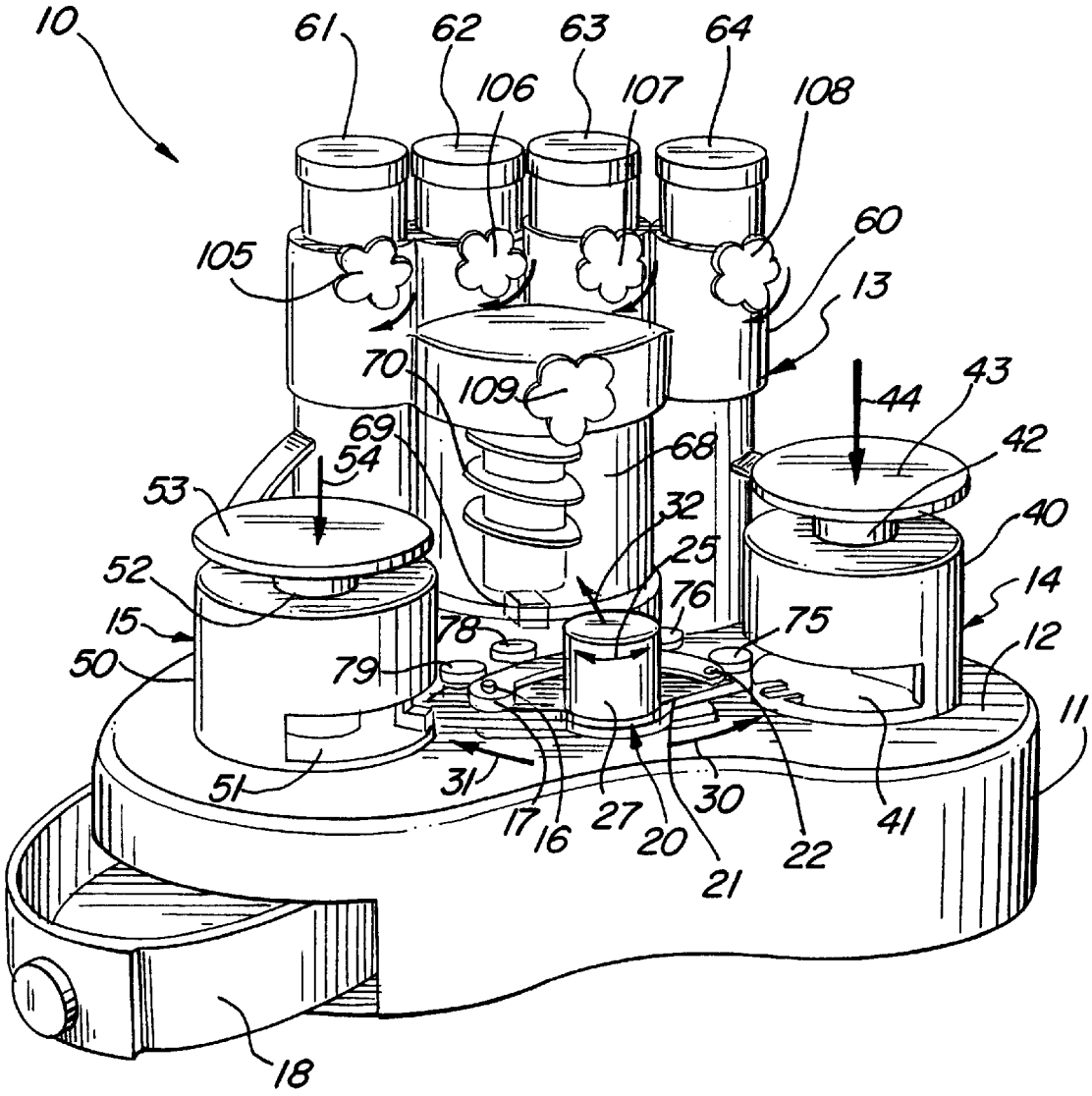
FIG. 1 sets forth a perspective view of an artificial fingernail and apparatus therefore constructed in accordance with the present invention.

FIG. 1 sets forth a front perspective view of a fingernail apparatus constructed in accordance with the present invention and generally referenced by numeral 10. Apparatus 10 includes a base 11 defining an upper surface 12, a mixing station 13, a nail press station 14 and a cutting station 15. Upper surface 12 further defines a slot 16 having a three slot convergence which is better seen in FIG. 2. Apparatus 10 further includes a sprue support 20 having a plate 21 defining an arcuate outer edge together with an upwardly extending generally cylindrical handle 27. As is better seen in FIG. 3, sprue support 20 further includes a downwardly extending post 26 which is received within slot 16.

In accordance with an important aspect of the present invention, apparatus 10 further includes a nail sprue 17 supported upon sprue support 20. The structure of nail sprue 17 is set forth below in greater detail in FIG. 3. However, suffice it to note here, that nail sprue 17 defines a generally arcuate portion corresponding to sprue support 20 and is received and supported thereon. In addition, nail sprue 17 will be understood to support a plurality of radially extending nails such as nails 75, 76, 78 and 79. As is also better set forth in below in FIG. 3, sprue support 20 includes a plurality of upwardly extending location pins such as pins 22 and 24 which are received within apertures formed in sprue 17 to locate sprue 17 and fix its position upon plate 21 of sprue support 20.

Nail press station 14 is set forth below in FIG. 4 in greater detail. However, suffice to note here, that nail press station 14 is supported by upper surface 12 and defines a generally cylindrical housing 40 having a slot 41 formed therein. Housing 40 further supports a shaft 42 extending downwardly into housing 40 which in turn supports a knob 43. By means set forth below in greater detail, knob 43 is movable with respect to housing 40 in the downward direction indicated by arrow 44.

Sprue cutting station 15 is set forth below in greater detail in FIGS. 5 and 6. However, suffice it to note here, that sprue cutting station 15 includes a generally cylindrical housing 50 supported upon upper surface 12 and having a slot 51 formed therein. Housing 50 further supports a shaft 52 extending downwardly into housing 50 and supporting a knob 53. Shaft 52 is supported in a movable attachment allowing knob 53 to be forced downwardly as indicated by arrow 54 moving shaft 52 further into housing 50.

Mixing station 13 includes a plurality of ornament containers 61, 62 and 63 each supporting a quantity of ornaments such as small beads or the like (not shown). By means not shown, containers 61 through 64 include passages facilitating communication with a mixer hopper 68 also formed in housing 60. Hopper 68 further supports a mixer 70 generally resembling a large screw or auger. Hopper 68 further defines a dispensing valve 69 at the lower end thereof. Containers 61 through 64 are provided with internal dispensing valves (not shown) each operated by a corresponding rotatable knob 105, 106, 107 and 108. Hopper 68 further includes a rotatable knob 109 which by means not shown but in accordance with conventional fabrication techniques, is operatively coupled to mixer 70 to provide rotation of mixer 70 as knob 109 is rotated.

In operation, and by way of overview, apparatus 10 utilizes a nail sprue supporting a plurality of nails having a recess formed therein together with a substantially identical nail cap sprue which supports a plurality of radially extending nail caps. As is better seen in FIGS. 3 and 7 below, each corresponding nail and nail cap are snap-fittable together to confine a volume or cavity therebetween. The overall objective of the present invention apparatus is to facilitate filling or partially filling the cavity of a plurality of nails and thereafter snap-fitting the nail caps to each of their respective nails to provide a complete structure. Toward this end, apparatus 10 utilizes sprue support 20 to support and manipulate the nails and nail caps in an interesting and convenient manner readily mastered by young children.

More specifically, the child user initially places a nail sprue upon sprue support 20 and moves the combined structure of sprue support 20 and the supported nail sprue such as nail sprue 17 forwardly within slot 16 in the direction indicated by arrow 32. The child user then rotates handle 27 in the manner indicated by arrows 25 to position each nail beneath dispensing valve 69 of hopper 68. The child user then uses dispensing valve 69 to dispense a quantity of beads or other small ornament material into each of the nails. During this dispensing process, each nail is easily rotated into the appropriate position beneath dispensing valve 69 by rotating handle 27. In addition, the child user may place other objects not dispensed from hopper 68 into the various recesses of the nails supported by sprue 17. When the desired materials have been placed within each of the recesses within the nails supported by nail sprue 17, the user then adds a second sprue in the manner shown in FIG. 3 on top of nail sprue 17. This second sprue supports a corresponding plurality of nail caps which are configured in the manner shown in FIG. 7 to snap-fit into the open face of each nail.

Once the second sprue supporting a plurality of nail caps is fitted upon sprue 17, the user then withdraws sprue support 20 outwardly from hopper 68 to the forward end of slot 16 and thereafter slides the combined structure of sprue support 20 and the pair of sprues supported thereon in the direction indicated by arrow 30 into slot 41 of nail press station 14. In the manner set forth below in FIG. 4, nail press station 14 utilizes the downward force upon knob 43 to snap-fit each nail cap into its underlying nail in a simple downward movement of knob 43. Thus, the child user sequentially positions each nail cap and underlying nail within slot 41 and presses the nail cap into its underlying nail to snap-fit the two together. Once again, rotation of handle 27 allows movement of each respective pair of nail caps and nails into the appropriate pressing location within slot 41.

Once each nail cap has been press fitted into its respective underlying nail, the various ornament items such as beads or the like previously placed within the nails is now captivated therein. In the final step of fabrication, the user withdraws the combined structure of sprue support 20 and the supported sprues outwardly from slot 41 and thereafter moves sprue support 20 within slot 16 toward cutting station 15 in the direction indicated by arrow 31. Cutting station 15 is positioned appropriately with respect to slot 16 to facilitate the extension of each nail and nail cap into slot 51 to facilitate cutting of the supporting branches thereof and separation from their respective sprues. This cutting operation is set forth below in FIGS. 5 and 6 in greater detail. However, suffice it to note here, that the operation involves simply maintaining sprue support 20 at the end of slot 16 proximate to cutting station 15 and thereafter rotating handle 27 to sequentially position each nail and nail cap pair within cutting station 15 to facilitate and cutting and separation from their respective sprues. Each cutting operation is executed by simply pressing knob 53 downwardly in the direction indicated by arrow 54. As is also better seen in FIG. 6, each separated nail and nail cap assembly cut from its supporting sprues falls downwardly from cutting station 15 into drawer 18. Once the number of nails and nail caps with their captive ornament objects has been fabricated and cut to fall into drawer 18, the user simply then withdraws the material from drawer 18 and applies it to fingernails using appropriate adhesive in accordance with conventional artificial nail techniques. Once the nails and nail caps have been cut from their respective sprues, the sprues are removed from sprue support 20 and discarded.

Figure 2:
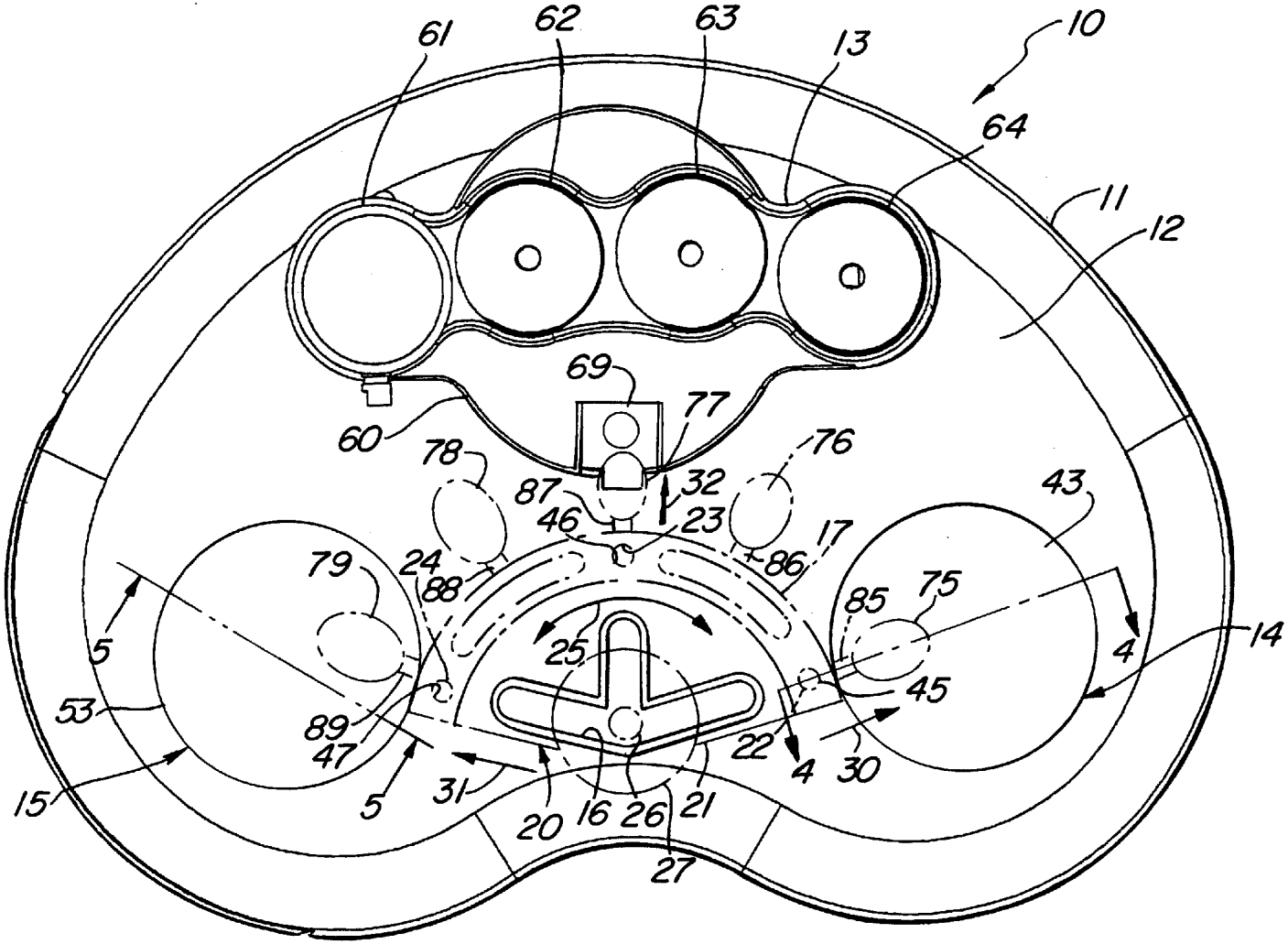
FIG. 2 sets forth a top view of the fingernail and apparatus constructed in accordance with the present invention.

FIG. 2 sets forth a top plan view of apparatus 10 showing an exemplary nail sprue 17 supported upon sprue support 20 both of which are shown in phantom depiction. It will be understood that the drawing of FIG. 2 is some what simplified in that certain feature details of apparatus 10 have been omitted to facilitate a clear description and illustration of the movement of sprue support 20 and nail sprue 17 between mix hopper 68, nail press station 14 and sprue cutting station 15.

More specifically, apparatus 10 includes a base 11 having an upper surface 12. Upper surface 12 defines a slot 16 having three commonly connected branches. Upper surface 12 further supports a nail press station 14 and a sprue cutting station 15. A mixing station 13 is also supported upon base 11 and includes a mix hopper 68 having a dispensing valve 69 supported thereon. Mixing station 13 further supports a plurality of ornament containers 61, 62, 63 and 64.

A sprue support 20 defines a substantially arcuate plate 21 supporting a downwardly extending post 26 and an upwardly extending handle 27. Post 26 is received within slot 16 to provide guide and location for sprue support 20. An illustrative nail sprue 17 is received upon sprue support 20. Nail sprue 17 is correspondingly arcuate to fit upon sprue support 20 and defines a plurality of locating apertures 45, 46 and 47. Apertures 45 through 47 receive locating pins 22, 23 and 24 of sprue support 20 to properly position nail sprue 17. It will be understood that pins 22 through 24 of sprue support 20 are sufficient in length to pass through a pair of sprues located upon sprue support 20. Nail sprue 17 an example of a typical sprue of pair of sprues to be positioned upon sprue support 20. Nail sprue 17 supports a plurality of upwardly open nails 75, 76, 77, 78 and 79 secured by a corresponding plurality of branches 85, 86, 87, 88 and 89 to form a generally radial pattern.

Of importance to note in FIG. 2, is the operation by which sprue support 20 is movable through the movement of post 26 within slot 16 to facilitate a forward movement of sprue support 20 and nail sprue 17 toward mixing station 13 in the direction indicated by arrow 32 to position a selected nail beneath dispensing valve 69. Further, the pivotal movement of handle 27 in the manner indicated by arrows 25 in either direction facilitates positioning each remaining nail beneath dispensing valve 69. In addition, the child user may elect to simply place articles or ornamental objects within one or more of nails 75 through 79 without the use of mixing station 13 as desired.

In any event, once the ornamental material has been deposited within each of nails 75 through 79, the movement of sprue support 20 guided by post 26 within slot 16 allows the user to withdraw sprue support 20 away from mixing station 13 and thereafter move it in the direction indicated by arrow 30 to position each nail within nail press station 14. Once again, each nail may be sequentially placed within nail press station 14 by rotating sprue support 20 in the directions indicated by arrows 25.

Finally, the combined structure of sprue support 20 and sprue 17 may be moved outwardly from press station 14 and guided within slot 16 by post 26 in the direction indicated by arrow 31 to position the plurality of nails within cutting station 15. It will be recalled from the above described operation that the movement to press station 14 and cutting station 15 is preceded by the addition of a second sprue upon nail sprue 17 such as nail cap sprue 90 shown in FIG. 3. By means described below in greater detail, nail press station 14 provides the snap-fit attachment of each nail cap to its underlying nail (seen in FIG. 3) while the operation of sprue cutting station 15 provides separation of each combined nail and nail cap from their respective sprues by cutting their support branches such as branch 89 supporting nail 79.

Figure 3:
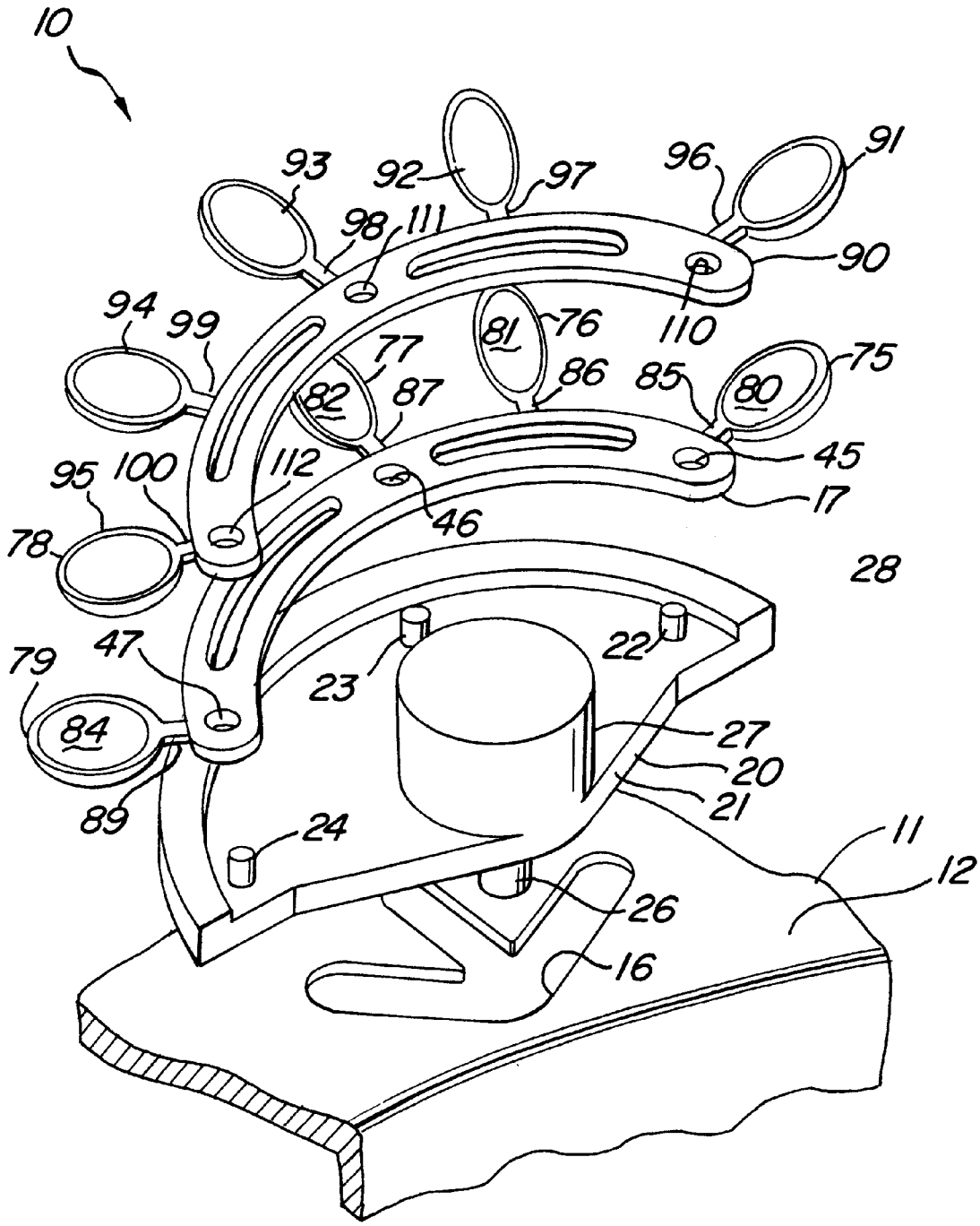
FIG. 3 sets forth a partial perspective assembly view of the present invention artificial fingernails and apparatus therefore.

FIG. 3 sets forth a partial perspective assembly view of a nail sprue together with a nail cap sprue supported upon sprue support 20 which in turn is supported upon base 11. Of importance to note in FIG. 3 in particular, is the manner in which a pair of sprues are fitted upon and located upon sprue support 20 allowing sprue support 20 to facilitate the above described manipulations of the nails and nail caps.

More specifically, apparatus 10 includes a base 11 defining an upper surface 12 which in turn defines a slot 16. Slot 16 includes a pair of angled branches and a front-to-back branch commonly joined to facilitate movement therebetween. A sprue support 20 includes an arcuate plate 21 supporting a downwardly extending post 26 and an upwardly extending handle 27. Plate 21 further supports a plurality of upwardly extending locating pins 22, 23 and 24 together with a raised rim 28. A nail sprue 17 defines a generally arcuate shape having a plurality of locating apertures 45, 46 and 47 formed therein. Sprue 17 further includes a plurality of nails 75, 76, 77, 78 (seen in FIG. 1) and 79 each joined to the remainder of sprue 17 by corresponding branches 85, 86, 87, 88 and 89. A nail cap sprue 90 defines a generally arcuate shape corresponding to sprue 17 and having corresponding locating apertures 110, 111 and 112. Nail cap sprue 90 supports a plurality of nail caps 91, 92, 93, 94 and 95 extending outwardly from branches 96, 97, 98, 99 and 100.

In operation, sprue support 20 is positioned upon surface 12 such that post 26 is received within slot 16. Thereafter, nail sprue 17 is placed upon sprue support 20 using locating pins 22 through 24 and locating apertures 45 through 47. Once the desired articles have been place within apertures 80 through 84 of nails 75 through 79, the user then places nail cap sprue 90 on top of nail sprue 17 and undertakes the above described press fitting of each cap to its underlying nail and the above described cutting process to separate the snap-fitted combination from their respective sprues.

Figures 4, 7:
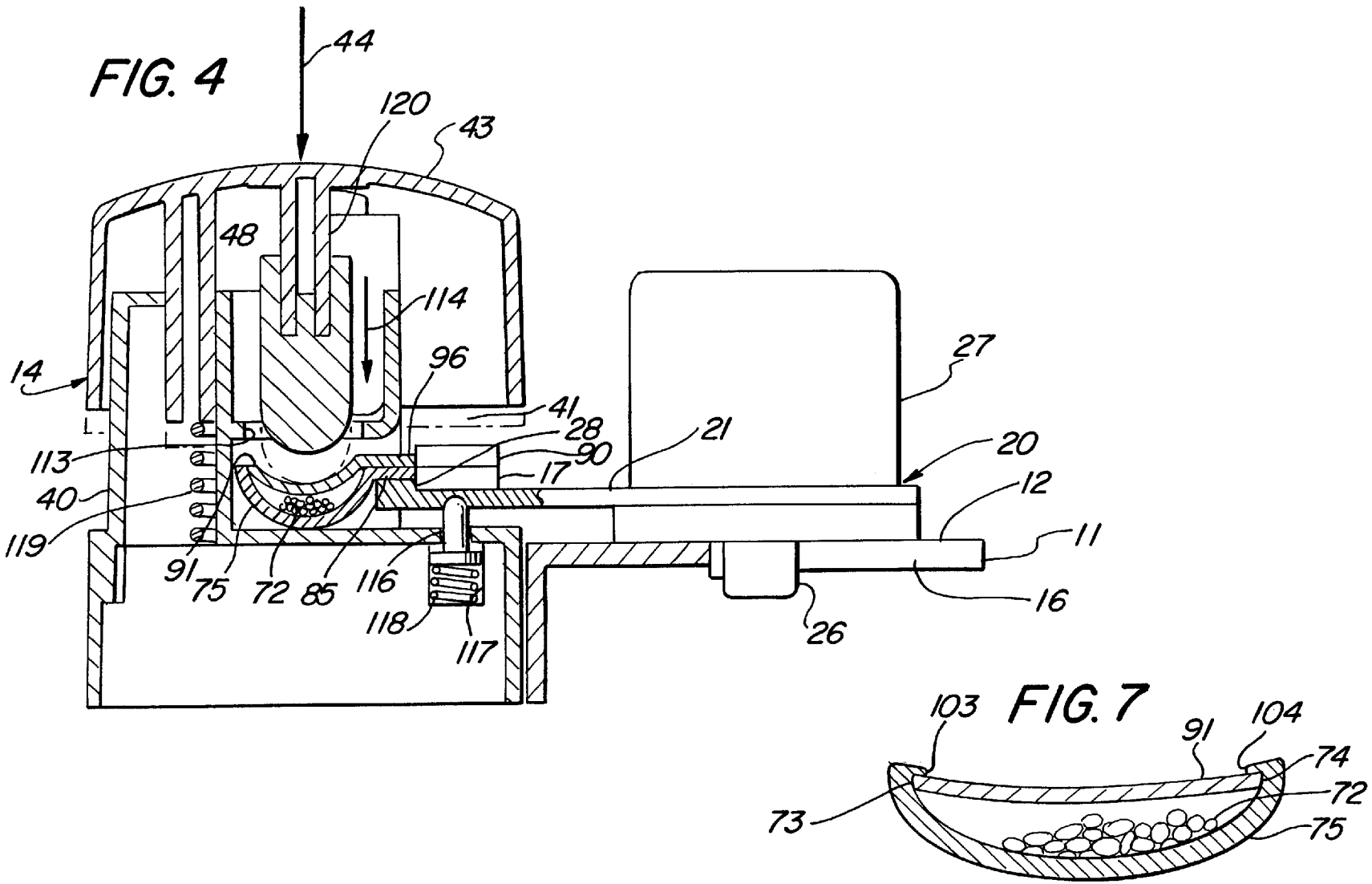
FIG. 4 sets forth a section view of the present invention artificial fingernail apparatus taken along section lines 4—4 in FIG. 2.
FIG. 7 sets forth a section view of a typical artificial fingernail constructed in accordance with the present invention.

FIG. 4 sets forth a partial section view of the present invention fingernail apparatus taken along section lines 4—4 in FIG. 2. Nail press station 14 is supported upon base 11 and extends upwardly from surface 12 thereof. It will be noted that the example of nail press station 14 shown in FIG. 4, utilizes a somewhat different shape for knob 43. It will be apparent from the descriptions which follow that nail press station 14 functions in substantially the same manner whether utilizing knob 43 shown in FIG. 1 or knob 43 as shown in FIG. 4. Nail press station 14 includes a housing 11 defining a slot 41 and supporting knob 43. A return spring 119 is coupled to knob 43 and produces a return spring force urging knob 43 to the raises position shown in solid line representation in FIG. 4. Housing 40 further supports an indexing pin 116 which is received within a recess 117 and urged upwardly by a spring 118. Knob 43 further supports a downwardly extending post 120 having a further downwardly extending press member 48. Press member 48 passes through an aperture 113.

Base 11 further supports a sprue support 20 having a post 26 received within slot 16 formed in base 11. Sprue support 20 further includes a plate 21 and an upwardly extending handle 27. Plate 21 extends into slot 41 and supports a nail sprue 17 and a nail cap sprue 90. Plate 21 further defines a detent recess 115 on the underside thereof which receives pin 116 to locate the rotational position of plate 21 within nail press station 14. It will be recalled from the descriptions of FIG. 3 set forth above, that sprues 17 and 90 are located by a plurality of pins and apertures to properly position sprues 17 and 90 upon plate 21. This proper positioning together with the cooperation of pin 116 within detent 115 assures that a selected nail and nail cap are properly positioned within press station 14.

Accordingly, in the position shown in FIG. 4, nail 75 supported upon nail sprue 17 by a branch 85 is positioned beneath press member 48. In accordance with the present invention, a plurality of ornamental objects 72 such as colorful beads or the like, are received within nail 75. In further accordance with the present invention, nail cap sprue 90 positions a corresponding nail cap 91 above nail 75 which is supported upon sprue 90 by a branch 96.

Thus, in the configuration shown in solid line representation in FIG. 4, sprue support 20 has positioned nail 75 and nail cap 91 in the correct position to press nail cap 91 into nail 75 in the snap-fit attachment shown below in FIG. 7. Accordingly, with nail 75 and nail cap 91 thus positioned and ornaments 72 captive within nail 75, the user simply forces knob 43 downwardly in the direction indicated by arrow 44 which in turn forces press member 48 against the force of return spring 119 in the direction indicated by arrow 114. The downward extension of knob 43 and press member 48 is shown in phantom line depiction in FIG. 4. Once sufficient force has been applied to nail cap 91 to snap-fitted to nail 75, the user simply releases knob 43 allowing spring 119 to return it to its raised position.

The pressing operation within nail press station 14 is carried forward as each combination of nail and nail cap supported upon plate 21 is rotated into the appropriate position. Following the completion of the cap fitting operation, handle 27 and sprue support 20 are withdrawn from nail press station 14 in the manner described above and repositioned in the appropriate alignment with sprue cutting station 15 (seen in FIG. 5).

Figure 5:
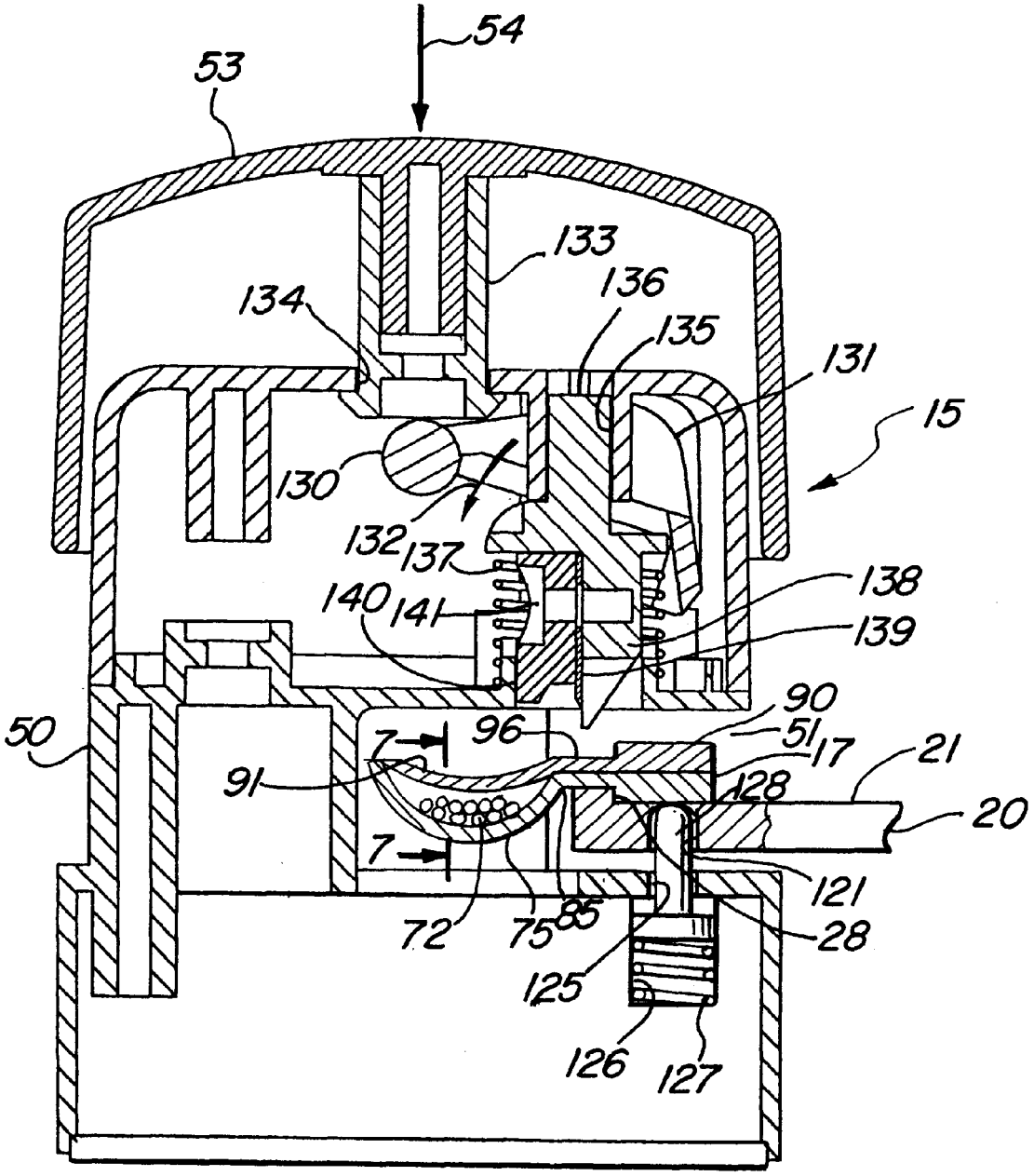
FIG. 5 sets forth a partial section view of the present invention artificial fingernail apparatus taken along section lines 5—5 in FIG. 2 showing the cutting station in its opened position.

FIG. 5 sets forth a partial section view of the present invention fingernail apparatus taken along section lines 5—5 in FIG. 2. By way of overview, FIGS. 5 and 6 show section views along section lines 5—5 in FIG. 2 with the difference being that FIG. 5 shows nail cutting station 15 in the open position while FIG. 6 shows nail cutting station 15 in the closed position following a cutting stroke.

More specifically, nail cutting station 15 includes a movable knob 53 supported upon a housing 50. Housing 50 defines a slot 51 having a locating pin 128 supported within an aperture 125. The lower end of pin 128 is received within a recess 126 and is urged upwardly by a spring 127. Plate 21 of sprue support 20 is shown extending into slot 51 and is positioned by the cooperation of a detent recess 121 formed in plate 21 and pin 128. Plate 21 further includes a rim 28. A nail sprue 17 and a nail cap sprue 90 are received upon plate 21 as described above and include respective inwardly extending branches 85 and 96.

Nail cutting station 15 further includes a post 133 extending downwardly through an aperture 134 formed in housing 150. A pivot arm 131 is pivotally supported within housing 50 by conventional means (not shown) and is coupled to a shaft 130. Shaft 130 passes beneath the lower end of post 133. Housing 50 further defines a bore 135 within which a post 136 is slidably supported. Post 136 is joined to a blade guide 138 extending downwardly therefrom. A cutting blade 139 is secured to blade guide 138 by a retainer 140 and a conventional fastener 141. A return spring 137 is operative upon blade guide 138 to provide a return spring force urging blade guide 138 together with blade 139 and retainer 140 upwardly.

In operation, with sprue support 20 positioned to align nail 75 and nail cap 91 within nail cutting station 15, the user then forces knob 53 downwardly in the direction indicated by arrow 54 overcoming the force of spring 137. As knob 53 is forced downwardly, it impacts shaft 130 and causes pivot arm 131 to pivot in the direction indicated by arrow 132. As pivot arm 131 pivots downwardly under the force of post 133 against shaft 130, the combined structure of blade 138, blade 139 and retainer 140 is forced downwardly forcing the cutting edge of blade 139 against branches 96 and 85 severing both branches and separating the combined structure of nail 75 and nail cap 91 from sprues 17 and 90. It will be recalled, that prior to the positioning of sprues 17 and 90 within nail cutting station 15, the combination of nail 75 and nail cap 91 was joined in the operation of nail pressing station 14 (seen in FIG. 4).

Figure 6:
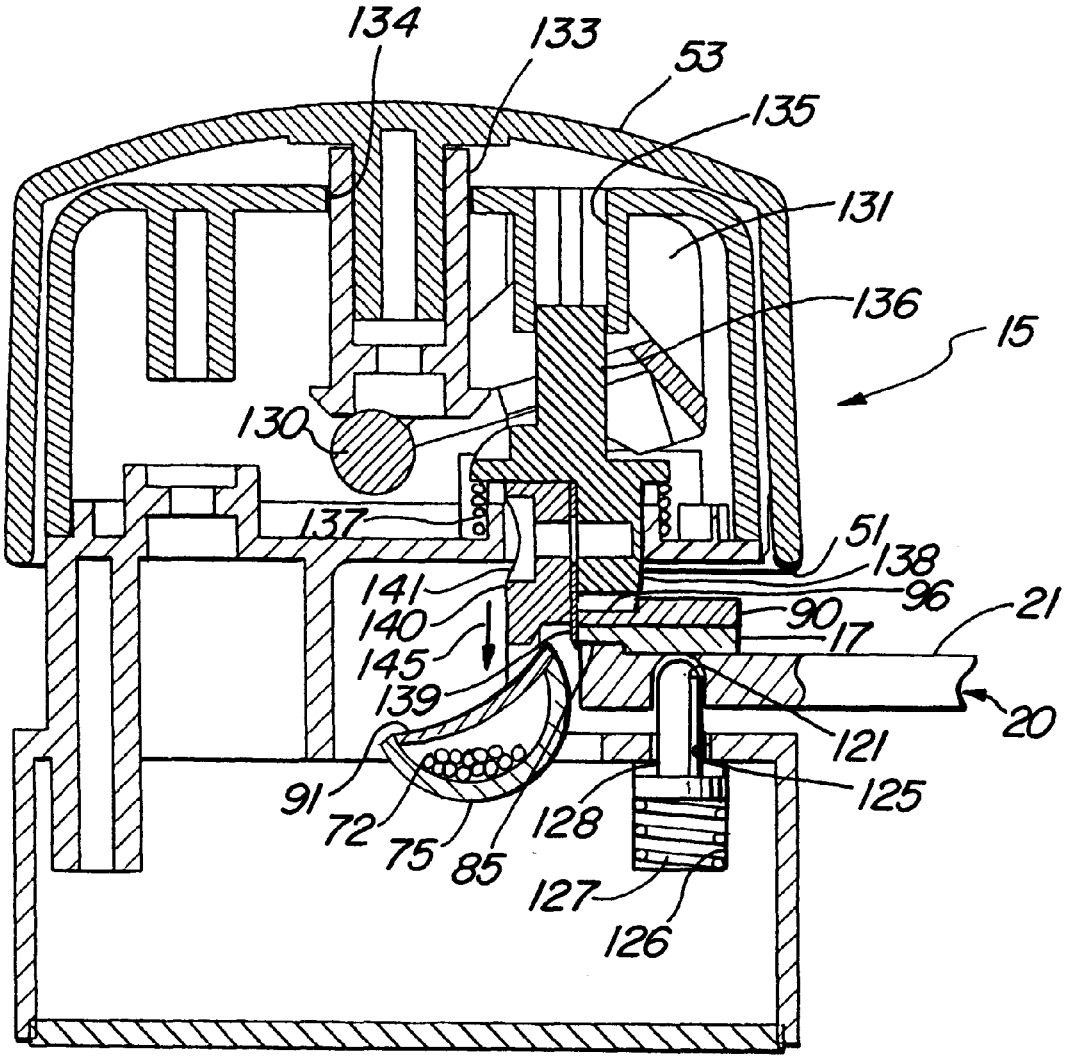
FIG. 6 sets forth the section view of FIG. 5 showing the cutting station of the present invention artificial fingernail apparatus in the closed or cutting position.

FIG. 6 sets forth a section view of nail cutting station 15 taken along section lines 5—5 in FIG. 2 following the completion of the above described cutting stroke. Thus, FIG. 6 shows nail cutting station 15 at the completion of a cutting stroke severing the supporting branches which have thus far supported nail 75 and nail cap 91 upon their respective sprues.

More specifically, nail cutting station 15 includes a movable knob 53 supported upon a housing 50. Housing 50 defines a slot 51 having a locating pin 128 supported within an aperture 125. The lower end of pin 128 is received within a recess 126 and is urged upwardly by a spring 127. Plate 21 of sprue support 20 is shown extending into slot 51 and is positioned by the cooperation of a detent recess 121 formed in plate 21 and pin 128. Plate 21 further includes a rim 28. A nail sprue 17 and a nail cap sprue 90 are received upon plate 21 as described above and include respective inwardly extending branches 85 and 96.

Nail cutting station 15 further includes a post 133 extending downwardly through an aperture 134 formed in housing 150. A pivot arm 131 is pivotally supported within housing 50 by conventional means (not shown) and is coupled to a shaft 130. Shaft 130 passes beneath the lower end of post 133. Housing 50 further defines a bore 135 within which a post 136 is slidably supported. Post 136 is joined to a blade guide 138 extending downwardly therefrom. A cutting blade 139 is secured to blade guide 138 by a retainer 140 and a conventional fastener 141. A return spring 137 is operative upon blade guide 138 to provide a return spring force urging blade guide 138 together with blade 139 and retainer 140 upwardly.

Once blade 139 has been forced through branches 85 and 96, the combined structure of nail 75, nail cap 91 and the plurality of ornament objects 72 captivated therein drops downwardly through nail cutting station 15 and is collected within drawer 18 (seen in FIG. 1). Thereafter, the user releases knob 53 allowing spring 137 to force knob 53 together with blade guide 138, blade 139, retainer 140 and fastener 141 upwardly returning cutting station 15 to the open position shown in FIG. 5. Thereafter, sprue support 20 is rotated in the manner described above to position the next fingernail and nail cap within the cutting station. This process is repeated as each nail and nail cap combination is severed from their respective branches and sprues. Once the sprue has been completely emptied, sprue support 20 is withdrawn from nail cutting station 15 and a new nail sprue is installed upon sprue support 20 and the process may be repeated.

Once a sufficient number of nails having their respective nail caps snap-fitted thereon have been accumulated within drawer 18 (seen in FIG. 1), the user may them employ conventional adhesive methods for attaching the ornamented nails to the user's nails as desired.

FIG. 7 sets forth a section view of a combined nail and nail cap taken along section lines 7—7 in FIG. 5. Nail 75 defines a generally curved member having a pair of inwardly extending snap ribs 103 and 104 positioned along the upper edge thereof. A nail cap 91 having edges 73 and 74 is snap-fitted within nail 75 in the above described pressing operation. In the preferred fabrication of the present invention, nail 75 is formed of a somewhat resilient plastic material such as molded plastic or the like. This allows a slight flexing of nail 75 and snap ribs 103 and 104 to facilitate the snap-fit attachment of nail cap 91. Further, in the preferred fabrication of the present invention, nail 75 is formed of a transparent or clear material allowing full view of a plurality of ornament objects 72 captivated between nail 75 and nail cap 91. In further accordance with the preferred fabrication of the present invention, nail cap 91 may be formed of a colored or opaque material to provide an appropriate background color for ornament objects 72.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. An artificial fingernail decorating and fabricating playset comprising:

a plurality of arcuate nail sprues each having a plurality of curve nails joined thereto by a supporting branch;

a plurality of arcuate nail cap sprues each having a plurality of nail caps joined thereto by a supporting branch;

a base;

a sprue support constructed to receive and support selected ones of said nail sprues and said nail cap sprues, said sprue support being supported upon said base and being movable between a first position and a second position and being rotatable at each of said first and second positions;

a nail pressing station supported by said base and positioned to receive a selected nail and selected nail cap, said nail pressing station having means for pressing said selected nail cap into said selected nail; and a sprue cutting station supported by said base and positioned to receive a selected nail and selected nail cap, said sprue cutting station having means for cutting said supporting branches of said selected nail and nail cap.

2. The artificial fingernail decorating and fabricating playset set forth in claim 1 further including a plurality of ornament objects defining sizes which allow said objects to be received between said nails and said nail caps prior to pressing said nail caps into said nails.

3. The artificial fingernail decorating and fabricating playset set forth in claim 2 further including a mixing station supported on said base having means for holding and means for dispensing said ornament objects and wherein said sprue support is movable to and rotatable at a third position, said mixing station means for dispensing operative to dispense a quantity of said ornament objects into selected ones of said nails.

4. An artificial fingernail decorating and fabricating playset comprising:

a base;

a mixing station supported on said base and having a quantity of ornament objects and dispensing means for dispensing a portion of said quantity of ornament objects;

a pressing station supported on said base and having pressing means;

a cutting station supported on said base and having cutting means;

a sprue support movably supported on said base;

a nail sprue having a plurality of upwardly open nails each joined to said nail sprue by a nail branch, said nail sprue constructed to be received upon said sprue support; and a nail cap sprue having a plurality of nail caps each joined to said nail cap sprue by a cap branch, said nail cap sprue constructed to be received upon said nail sprue such that each of said nail caps overlies one of said nails, said sprue support initially receiving said nail sprue and each of said nails receiving a quantity of said ornament objects and said nail cap sprue being received upon said nail sprue, and said sprue support, said nail sprue and said nail cap sprue being movable to and rotatable at said pressing station and movable to and rotatable at cutting station for operation of said pressing means and said cutting means.

5. The artificial fingernail decorating and fabricating playset set forth in claim 4 wherein said sprue support is movable to rotatable at said mixing station for operation of said dispensing means.

6. The artificial fingernail decorating and fabrication playset set forth in claim 5 wherein said nails and said nail caps define cooperating snap-fit attachment means.

7. The artificial fingernail decorating and fabricating playset set forth in claim 6 wherein said nail sprue and said nail cap sprue are generally arcuate and wherein said nail branches and said cap branches extend generally radially from said nail sprue and said nail cap sprue respectively.

8. An artificial fingernail decorating and fabricating playset comprising:

a base;

a quantity of ornament objects;

a pressing station supported on said base and having pressing means;

a cutting station supported on said base and having cutting means;

a sprue support movably supported on said base;

a nail sprue having a plurality of upwardly open nails each joined to said nail sprue by a nail branch, said nail sprue constructed to be received upon said sprue support; and a nail cap sprue having a plurality of nail caps each joined to said nail cap sprue by a cap branch, said nail cap sprue constructed to be received upon said nail sprue such that each of said nail caps overlies one of said nails, said sprue support initially receiving said nail sprue and each of said nails receiving a quantity of said ornament objects and said nail cap sprue being received upon said nail sprue, and said sprue support, said nail sprue and said nail cap sprue being movable to and rotatable at said pressing station and movable to and rotatable at cutting station for operation of said pressing means and said cutting means.

9. The artificial fingernail decorating and fabrication playset set forth in claim 8 wherein said nails and said nail caps define cooperating snap-fit attachment means.

10. The artificial fingernail decorating and fabricating playset set forth in claim 9 wherein said nail sprue and said nail cap sprue are generally arcuate and wherein said nail branches and said cap branches extend generally radially from said nail sprue and said nail cap sprue respectively.

* * * * *